US011319901B2

(12) United States Patent
Hirama et al.

(10) Patent No.: US 11,319,901 B2
(45) Date of Patent: May 3, 2022

(54) FUEL NOZZLE FOR A ROTARY THROTTLE VALVE CARBURETOR

(71) Applicant: Walbro LLC, Tucson, AZ (US)

(72) Inventors: Taketoshi Hirama, Watari-gun (JP); Takumi Konarita, Shibata-Gun (JP)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 17/001,948

(22) Filed: Aug. 25, 2020

(65) Prior Publication Data

US 2021/0071622 A1 Mar. 11, 2021

Related U.S. Application Data

(60) Provisional application No. 62/898,853, filed on Sep. 11, 2019.

(51) Int. Cl.
*F02M 9/06* (2006.01)
*F02M 9/08* (2006.01)

(52) U.S. Cl.
CPC ..... *F02M 9/085* (2013.01); *F02M 9/06* (2013.01)

(58) Field of Classification Search
CPC ..... F02M 9/06; F02M 9/08; F02M 9/085
See application file for complete search history.

(56) References Cited

U.S. PATENT DOCUMENTS

| | | | | |
|---|---|---|---|---|
| 5,599,484 | A | 2/1997 | Tobinai | |
| 6,431,527 | B1 | 8/2002 | Suzuki et al. | |
| 7,114,708 | B2 | 10/2006 | Douyama et al. | |
| 10,890,140 | B2 * | 1/2021 | Nagata | F02M 19/04 |
| 2019/0162137 | A1 | 5/2019 | Hirama et al. | |

* cited by examiner

*Primary Examiner* — Robert A Hopkins
(74) *Attorney, Agent, or Firm* — Reising Ethington P.C.; Matthew J. Schmidt

(57) ABSTRACT

A rotary throttle valve carburetor includes a main body, a throttle valve and a fuel nozzle. The main body has a main bore with an inlet and an outlet, a valve bore that intersects the main bore and a nozzle opening that communicates with the main bore. The throttle valve has a body received at least partially within the valve bore so that the valve body rotates about an axis and moves axially relative to the main body, and a valve passage therethrough. The fuel nozzle extends through the nozzle opening and into the valve passage, and has a fuel outlet received within the valve passage, an inner surface that defines part of a fuel passage through which fuel flows in the nozzle and to the fuel outlet, and an outer surface that includes a discontinuous portion with a varying radial dimension.

15 Claims, 4 Drawing Sheets

FUEL NOZZLE FOR A ROTARY THROTTLE VALVE CARBURETOR

REFERENCE TO RELATED APPLICATIONS

This application claims the benefit of U.S. Provisional Application Ser. No. 62/898,853 filed on Sep. 11, 2019, the entire contents of which is incorporated herein by reference in its entirety.

TECHNICAL FIELD

The present disclosure relates generally to a fuel nozzle for a rotary throttle valve carburetor.

BACKGROUND

A rotary throttle valve carburetor for use in small internal combustion engines such as lawn mowers, motor scooters and the like includes a cylindrical rotary throttle valve with a valve passage that is selectively and variably registered with a mixing passage of the carburetor by rotating the throttle valve about an axis generally perpendicular to the mixing passage. A needle valve extends into the passage of the rotary valve, and a fuel nozzle projects into the mixing passage and slidably receives the tip of the needle valve. The needle is carried by a first portion of the throttle valve body which is coupled to a second portion of the throttle valve body in which the valve passage is formed. A valve bore intersects the mixing passage and the throttle valve is rotatably received in the valve bore. The needle is thus exposed to fluid flow through the valve bore and liquid fuel may engage and tend to collect on the exterior of the fuel nozzle.

SUMMARY

In at least some implementations, a rotary throttle valve carburetor includes a main body, a throttle valve and a fuel nozzle. The main body has a main bore with an inlet into which air enters the main bore and an outlet from which air and fuel exit the main bore, the main body also has a valve bore that intersects the main bore and a nozzle opening that communicates with the main bore. The throttle valve has a valve body received at least partially within the valve bore so that the valve body rotates about an axis and moves axially relative to the main body, and the throttle valve has a valve passage therethrough which is more aligned with the main bore in one position of the throttle valve than in another position of the throttle valve. The fuel nozzle extends through the nozzle opening and into the valve passage, and has a fuel outlet received within the valve passage, an inner surface that defines part of a fuel passage through which fuel flows in the nozzle and to the fuel outlet, and an outer surface that includes a discontinuous portion. The discontinuous portion has a varying radial dimension within the portion of the fuel nozzle that is within the valve passage.

In at least some implementations, the discontinuous portion is located below the fuel outlet relative to the direction of the force of gravity. In at least some implementations, at least a portion of the discontinuous portion is located between the fuel outlet and the outlet of the main bore relative to the direction of the flow of fluid through the main bore.

In at least some implementations, the nozzle has a rear surface facing in the opposite direction or within 20 degrees of the opposite direction as the fuel outlet, where the rear surface is parallel or within 20 degrees of parallel to the direction of air flow through the main bore. The nozzle may include at least one inclined side surface that extends from a first side near the fuel outlet to a second side joined to the rear surface, and wherein the at least one side surface may be inclined at an angle of between 20 and 60 degrees relative to the direction of the flow of fluid through the main bore. The discontinuous portion may be formed on the at least one side surface. The nozzle may include two side surfaces with a first side surface arranged with the second side upstream of the first side relative to the direction of air flow through the main bore, and a second side surface arranged with the first side upstream of the second side relative to the direction of air flow through the main bore. The fuel outlet may be oriented perpendicular to or within 30 degrees of perpendicular to a centerline of the main bore.

In at least some implementations, the discontinuous portion is defined at least in part by a projection that extends outwardly from an adjacent portion of the outer surface of the nozzle. Fuel flowing or otherwise on the outer surface of the fuel nozzle may engage the projection and be moved away from the outer surface of the fuel nozzle. The projection may have a side that extends radially from the fuel nozzle, relative to an axis of the fuel nozzle, and an angle between the side of the projection and the outer surface of the fuel nozzle may be at least 60 degrees. The angle between the side of the projection and the outer surface of the fuel nozzle may be 90 degrees.

In at least some implementations, the discontinuous portion has at least a portion that is oriented at an angle of less than 60 degrees relative to a centerline of the main bore.

In at least some implementations, the discontinuous portion is within 45 degrees circumferentially of the fuel outlet.

In at least some implementations, a portion of the outer surface of the fuel nozzle is located within the valve passage and is cylindrical or frustoconical, and oriented perpendicular to or within 15 degrees of perpendicular to the centerline of the main bore, and the discontinuous portion extends radially outwardly from the outer surface and covers less than ¼ of the circumference of the outer surface.

In at least some implementations, the discontinuous portion includes at least one projection that is angled circumferentially with a first portion of the projection located closer to the fuel outlet than a second portion of the projection spaced axially from the first portion.

BRIEF DESCRIPTION OF THE DRAWINGS

The following detailed description of certain embodiments and best mode will be set forth with reference to the accompanying drawings, in which.

DETAILED DESCRIPTION

Figure 1:
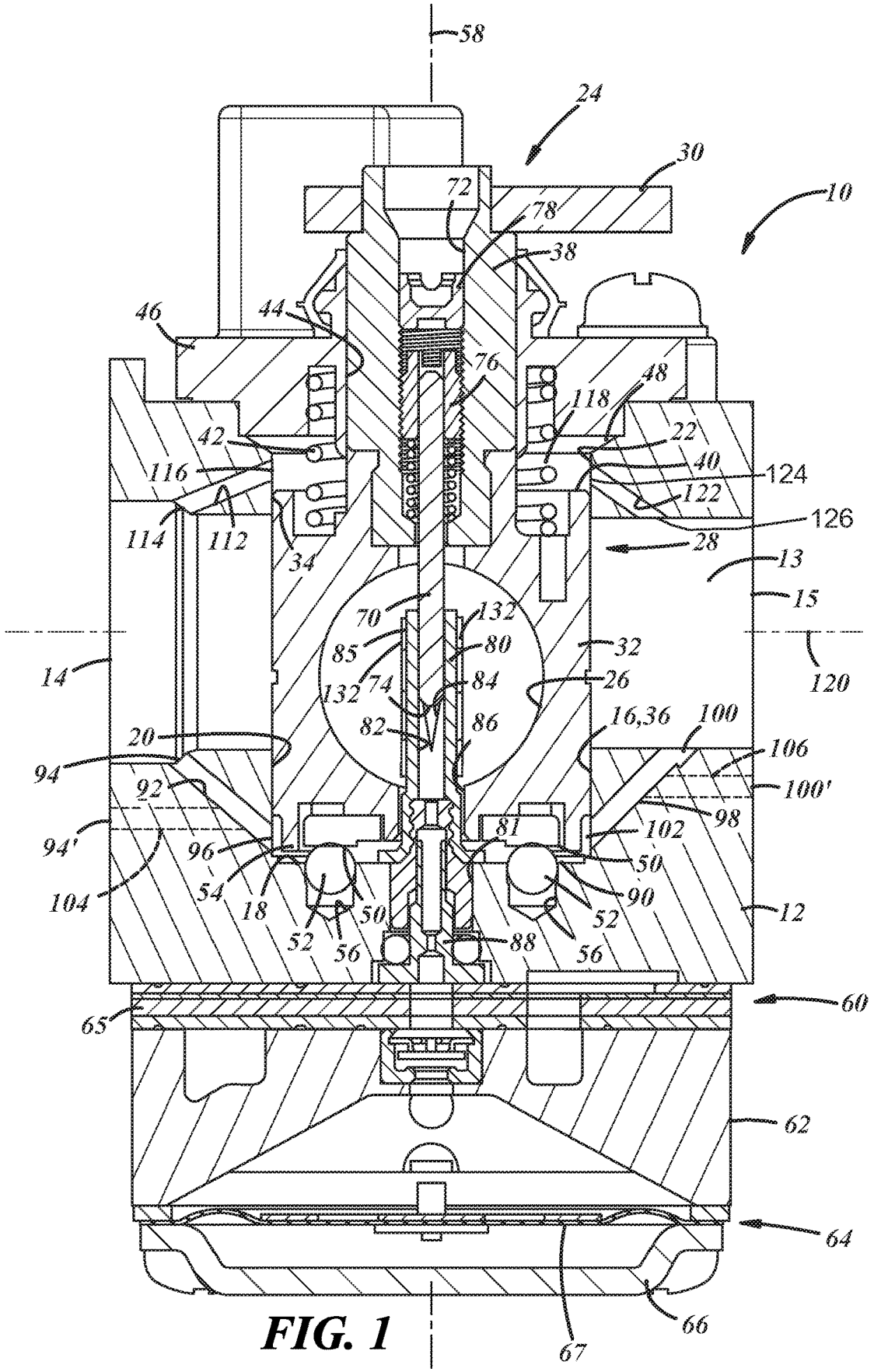
FIG. 1 is a perspective view of a carburetor with a rotary throttle valve.
Figure 2:
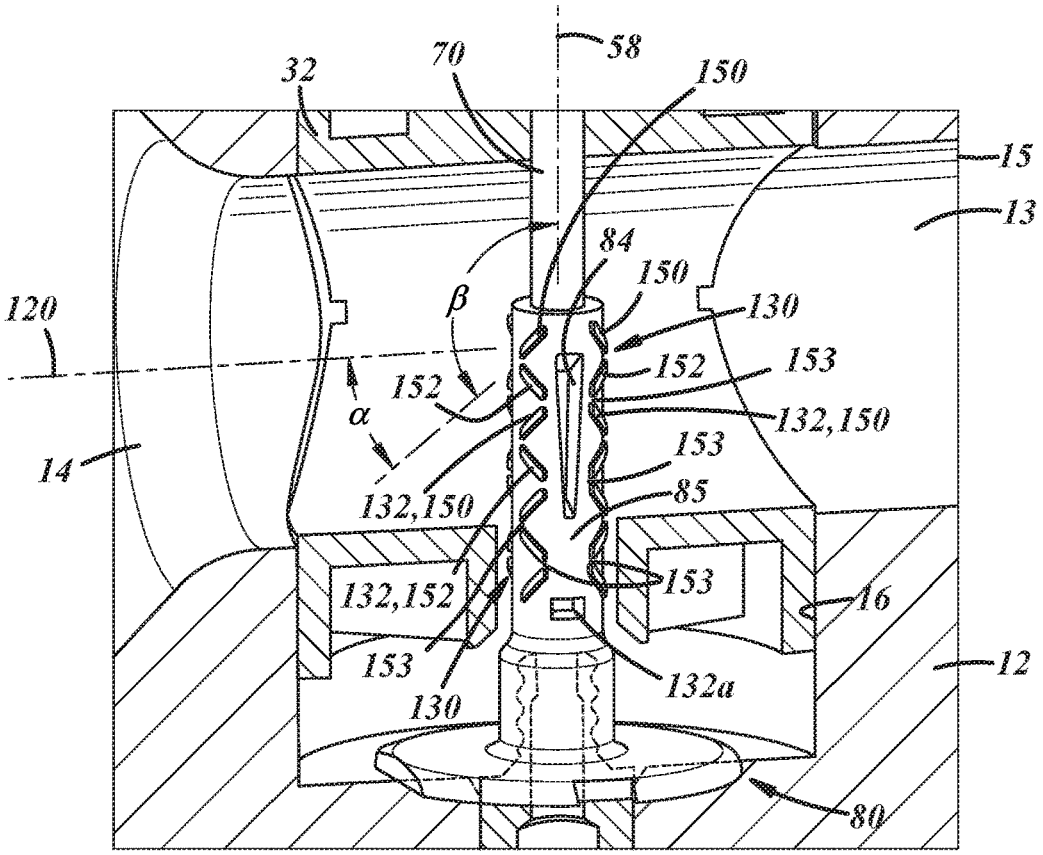
FIG. 2 is a sectional view of the carburetor of FIG. 1.

Referring in more detail to the drawings, FIGS. 1 and 2 illustrate a rotary throttle valve carburetor 10 that includes a carburetor main body 12 provided with a main bore 13. Air enters the main bore 13 at an inlet end 14, the air is mixed with fuel provided into the main bore 13, and a fuel and air mixture flows out of an outlet end 15 of the main bore 13 for delivery to an engine.

The carburetor main body 12 also includes a throttle valve bore 16 that intersects and may extend perpendicular to the main bore 13. The valve bore 16 may be a blind bore that is closed or dead-ends at a bottom wall 18 and has a generally cylindrical sidewall 20 that leads to an opening 22 at the end opposite the bottom wall 18. The bottom wall 18 may be located on one side of the main bore 13 and the opening 22 may be located on an opposite side of the main bore 13 from the bottom wall 18. Hence, an axial length of the sidewall 20 is interrupted by the main bore 13. The main body 12 may be formed of cast metal, such as diecast aluminum, or by other suitable methods and materials known in the art.

A rotary throttle valve 24 is rotatably and axially movably received in the valve bore 16 and includes an intake or valve passage 26 therethrough that is variably aligned or registered with the main bore 13 as the throttle valve 24 is rotated to selectively open and close the main bore 13. Rotation of the throttle valve 24 causes both the valve passage 26 to align or mis-align longitudinally with the main bore 13, and the throttle valve 24 to move axially within the valve bore 16 under control of a cam interface as will be described below (and with reference to the orientation of the carburetor shown in the drawings). The throttle valve 24 includes a valve body 28 and a throttle lever 30 coupled to the valve body 28.

The throttle valve body 28 may include a first portion 32 that is generally cylindrical and has an outer diameter sized for close receipt within the throttle valve bore 16. The first portion 32 may have an axial length such that part of the first portion 32 is received within an upper portion 34 of the valve bore 16 (defined between the main bore 13 and the opening 22) and part of the first portion 32 is received within a lower portion 36 of the valve bore 16 (defined between the main bore 13 and bottom wall 18). The valve body 28 may include a second portion 38 that is fixed to the first portion 32 so that the portions co-rotate. The second portion 38 may be generally cylindrical and may extend outwardly from the opening 22 of the valve bore 16. If desired, the second portion 38 may have a smaller outer diameter than the first portion 32, providing a circumferential shoulder 40 of the first portion 32 that is radially outboard of the second portion 38. A biasing member, shown as a coil spring 42, may engage the shoulder 40 and provide a force that tends to move the throttle valve 24 toward the bottom wall 18. The second portion 38 may be supported and rotatably journaled in an opening 44 formed in a throttle valve plate 46 that is coupled to the carburetor main body 12. The second portion 38 may extend through the opening 44 in the valve plate 46 and the throttle valve lever 30 may be coupled to the second portion 38 outboard of the throttle valve plate 46, that is, on the opposite side of the plate 46 than the main bore 13. Some clearance is provided between an inner surface 48 of the plate 46 (i.e. the surface facing the main bore 13) and the shoulder 40 of the throttle valve body 28, to permit movement of the throttle valve 24 within the valve bore 16 and relative to the plate 46, as set forth below.

The throttle valve lever 30 is coupled to an actuator (which may be a wire of a control or Bowden cable) that is actuated to rotate the throttle valve 24 toward a wide-open throttle position wherein the valve passage 26 is nearly or completely aligned with the main bore 13. As is known in the art, the plate 46 may carry a stop surface that is engaged by the throttle valve lever 30 to define the idle position of the throttle valve 24. The stop surface may be movable relative to the plate 46 to permit adjustment of the idle position of the throttle valve 24, if desired.

As the throttle valve 24 is rotated toward its wide-open position (FIG. 2) a cam surface 50 defined on or carried by the throttle valve body 28 rides over a cam follower 52, which carried by the carburetor main body 12. In the example shown, two cam surfaces 50 are formed in an insert fixed to the bottom 54 of the first portion 32 of the throttle valve body 28 (or may be formed in a bottom surface of the first portion) and may be received in slots 55 (FIG. 3) in the bottom wall 18. The cam surfaces 50 are engaged with one or more cam followers 52, which are shown as two spherical balls, pressed into cavities 56 in the bottom wall 18 of the valve bore 16 in the main body 12. Of course, the cam surface 50 could be carried by or defined in the bottom wall 18 and the followers 52 or balls could be carried by the valve body 28. And other arrangements may be used, for example, the cam may be associated with the throttle valve lever 30, or with the upper portion of the throttle valve body 28 and the valve plate 46, as desired. The slope of the cam surface 50 causes the throttle valve 24 to move axially away from the bottom wall 18 of the valve bore 16 (relative to the axis of rotation 58 (FIGS. 1 and 2) of the throttle valve 24, which is the axis of the valve bore) during rotation of the throttle valve 24 toward the wide-open position. As the throttle valve 24 rotates toward its idle position, the throttle valve 24 moves axially toward the bottom wall 18 of the valve bore 16. The spring 42 that biases the throttle valve 24 toward the bottom wall 18 ensures that the cam surface 50 remains engaged with the cam followers 52, and also, due to the slope of the cam surface 50, yieldably rotationally biases the throttle valve 24 toward its idle position.

In conventional manner, the carburetor 10 may include a fuel pump assembly 60 arranged or defined at least in part between a first plate 62 and the main body 12, and a fuel metering assembly 64 arranged or defined at least in part between a second plate 66 and the first plate. The fuel metering assembly 64 and fuel pump assembly 60 may each include separate diaphragms 65, 67 and valves to control fuel flow within and among these assemblies, as is known in the art. Fuel flows from the fuel pump assembly 60 to the fuel metering assembly 64, and from the fuel metering assembly 64 to the main bore 13.

As shown in FIGS. 1 and 2, to vary the fuel flow in and from the carburetor 10, the throttle valve 24 may carry a needle 70. The needle 70 may be carried by the throttle valve body 28 and is shown as being carried in a central bore 72 of the second portion 38 of the throttle valve body 28. The needle 70 extends into the valve passage 26 and has a distal or free end 74 that is located in the valve passage 26. The needle 70 may be adjustably received by a threaded carrier 76 that is threadedly received in the bore 72 of the second portion 38 of the throttle valve body 28. Hence, rotation of the carrier 76 axially moves the needle 70 relative to the throttle valve body 28 so that the needle 70 is moved relative to the valve passage 26. A plug 78 may prevent further adjustment of the needle 70 after it is moved to a desired or calibrated position, if desired. The plug 78 may also permit some limited adjustment of the needle 70, if desired. As the throttle valve 24 moves axially, the position of the needle 70 relative to the main bore 13 changes. To control fuel flow into the main bore 13, the needle 70 is received within and is moved relative to a main fuel nozzle 80.

The main fuel nozzle 80 may be carried by the main body 12, may extend through a nozzle opening 81 in the main body, and may have a passage 82 in which the needle 70 is received and a fuel outlet 84 (FIG. 2) that is, in at least some positions of the throttle valve 24, at least partially blocked by the needle 70. The main fuel nozzle 80 may extend through a bore 86 in the throttle valve body 28 that intersects or opens into the valve passage 26 so that the fuel outlet 84 is received within the valve passage 26. The main fuel nozzle 80 may include or be communicated with a fuel jet or restriction 88 located between the fuel outlet 84 and the fuel metering assembly 64, to provide a restricted fuel flow from the metering assembly 64 to the fuel outlet 84, if desired.

As the throttle valve 24 rotates and moves axially within the valve bore 16, the needle 70 moves with the throttle valve 24 and slides axially within the nozzle passage 82 in the main fuel nozzle 80 and relative to the fuel outlet 84 thereby adjusting or changing the effective size or flow area of the fuel outlet 84. In addition, rotation of the throttle valve 24 adjusts the degree or extent of communication between the main bore 13 and the valve passage 26 directly effecting the amount of air flow through the main bore 13. Generally, the higher the vertical position of the throttle valve 24 (e.g. the farther the throttle valve 24 is moved away from the bottom wall 18), the greater the airflow through the main bore 13, the larger the fuel outlet 84 flow area, and the greater the fuel flow into the valve bore 16 and out of the main bore 13.

Figure 4:
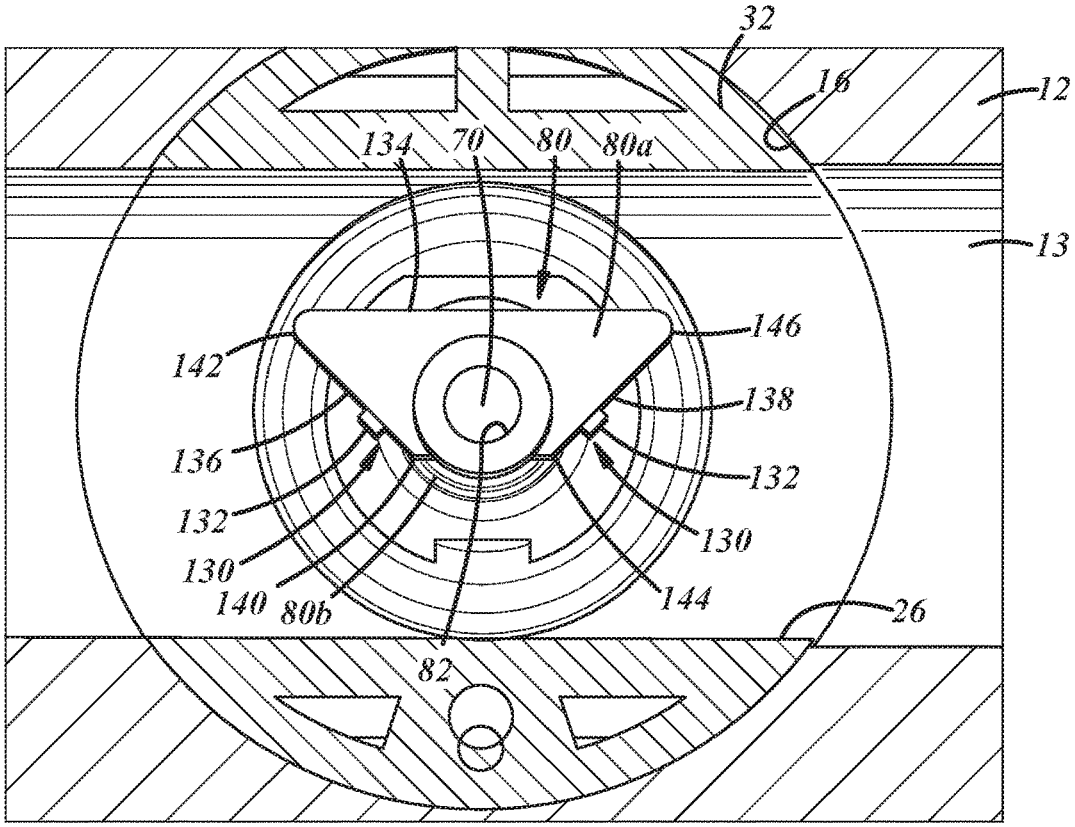
FIG. 4 is a fragmentary sectional view showing the main bore, throttle valve and a fuel nozzle of a rotary throttle valve carburetor.

As shown in FIGS. 1, 2 and 4, to provide air flow into the valve bore 16, specifically into a first chamber 90 that is defined between the bottom wall 18 and the main body 12 of the throttle valve 24, a first passage, which may be called an inlet passage 92, may be provided in the carburetor main body 12. The inlet passage 92 may communicate the first chamber 90 with an upstream portion of the main bore 13 which is a portion of the main bore 13 that extends from the main bore 13 inlet to the valve bore 16. The inlet passage 92 may have an inlet 94 communicated with the upstream portion of the main bore 13 and an outlet 96 that is open to or communicated with the first chamber 90. The inlet passage 92, specifically the outlet 96, may be communicated with the first chamber 90 in all positions of the throttle valve 24. That is, even when the throttle valve 24 is in the idle position wherein the first chamber 90 has its smallest volume, the inlet passage 92 may communicate with the first chamber 90. Accordingly, upstream of the throttle valve 24, air is directed to the first chamber 90.

To enable fluid flow out of the first chamber 90, a second passage, which may be called an outlet passage 98 may be provided in the carburetor main body 12. The outlet passage 98 may communicate the first chamber 90 with a downstream portion of the main bore 13, which is a portion of the main bore 13 that leads from the valve bore 16 to the main bore outlet 15. The outlet passage 98 may have an outlet 100 that is communicated with the outlet portion of the main bore 13 and an inlet 102 that is open to or communicated with the first chamber 90. The outlet passage 98 may communicate with the first chamber 90 in all positions of the throttle valve 24. That is, even when the throttle valve 24 is in the idle position wherein the first chamber 90 has its smallest volume, the outlet passage 98 may communicate with the first chamber 90 to permit fluid flow out of the first chamber 90. While the inlet 94 of the inlet passage 92 is shown as being open to the main bore 13, an inlet 94' could instead open to or through the inlet side of the main body 12 (as shown in dashed lines 104 in FIG. 1), assuming air is provided to the inlet 94' separate from the main bore 13. And while the outlet 100 of the outlet passage 98 is shown as being open to the main bore 13, an outlet 100' could instead open to or through the outlet side of the main body 12 (as shown in dashed lines 106), assuming the outlet 100' is communicated with a component downstream of the carburetor 10 such as an intake manifold of an engine. In this way, either or both of the inlet passage 92 and outlet passage 98 may be independent of the main bore 13 (which means not directly communicated therewith, recognizing that the valve bore 16 may communicate with the main bore 13 and hence, the inlet and outlet passages are indirectly communicated with the main bore 13 via the throttle valve bore 16).

As shown in FIG. 1, a third passage, which may be called a second inlet passage 112, may be provided spaced from the first inlet passage 92. The second inlet passage 112 may have an inlet 114 that communicates with the inlet portion of the main bore 13, or with the inlet side of the carburetor body (e.g. to receive an air flow separate from the main bore 13, if desired). The second inlet passage 112 may have an outlet 116 that communicates with a second chamber 118 that is defined within the valve bore 16 between the throttle valve body 28 and the throttle valve plate 46. The second inlet passage 112 is circumferentially spaced from the first inlet passage 92 (relative to the axis 120 (FIGS. 1 and 2) of the main bore 13) and may be generally diametrically opposed to the first inlet passage 92, if desired (wherein generally means within 20 circumferential degrees of diametrically opposed). In at least some implementations, the engine may be used in different orientations, and fuel may collect in the second chamber 118 in at least some orientations of the engine. Or it may be desirable to provide air flow into the second chamber 118 for other reasons. To provide air flow into the second chamber 118, the inlet 114 of the second inlet passage 112 may communicate with a supply of air upstream of the throttle valve 24 and the outlet 116 of the second inlet passage 112 may communicate with the second chamber 118, as generally set forth above with regard to the first inlet passage 92 and its inlet 94 and outlet 96. The air flow into the second chamber 118 from the second inlet passage 112 may dry out or prevent fuel from collecting in the second chamber 118. Some air may leak from the second chamber 118 into the main bore 13 through a gap or clearance between the throttle valve body 28 and the surface defining the valve bore 16.

Further, a fourth passage, which may be called a second outlet passage 122, may also be provided. The second outlet passage 122 may have an inlet 124 that communicates with the second chamber 118 and an outlet 126 that communicates with a downstream portion of the main bore 13 or with the outlet side of the carburetor main body 12. Thus, fluid flow out of the second chamber 118 may be accommodated through the second outlet passage 122, generally as set forth above with regard to the first outlet passage 98 and first chamber 90. One or both of the second inlet passage 112 and second outlet passage 122 may communicate with the second chamber 118 in all positions of the throttle valve 24, even in the wide-open position of the throttle valve 24 in which the second chamber 118 has its minimum volume. The second inlet passage 112 may be separate from and does not intersect the first inlet passage 92, and the second outlet passage 122 may be separate from and does not intersect the first outlet passage 98.

In at least some implementations, the nozzle fuel outlet 84 is oriented at a non-zero angle relative to the direction of airflow in the main bore 13, which may be parallel to and along a centerline 120 of the main bore 13. The orientation of the fuel outlet 84, sometimes referred to as the direction that the fuel outlet "faces", may be defined by the direction of fluid flow through the fuel outlet 84 from the nozzle passage 82 to the valve passage 26. In at least some implementations, the fuel outlet 84 may be oriented perpendicular to or within 30 degrees of perpendicular to the centerline 120 of the main bore 13. So arranged, fuel exits the fuel outlet 84 at a significant angle compared to the direction of air flowing in the main bore 13. Of course, the fuel outlet 84 may be oriented at other angles, including parallel to the main bore centerline 120. And the fuel outlet 84 may have any desired shape and may be defined by one or more voids in the nozzle, as desired.

The fuel nozzle passage 82 defines an inner surface of the nozzle 80 which faces inwardly toward the axis 58 and is opposite to the outwardly facing outer surface 85 of the nozzle 80 which faces away from the axis 58. In at least some implementations, the fuel outlet 84 is oriented perpendicular to or within 30 degrees of perpendicular to the centerline 120 of the main bore 13. Fluid flowing through the valve passage 26 passes around the outer surface 85 of the nozzle 80, and fuel that exits the nozzle through the fuel outlet 84 is mixed with air flowing through the valve passage 26 providing a fuel and air mixture within the main bore 13 downstream of the throttle valve 24. Due to surface tension of the liquid fuel, the orientation and/or changing direction of pressure forces acting on the fuel or for other reasons, some fuel may tend to cling to and wet the outer surface 85 of the nozzle 80, and at least some of that fuel may tend to flow in the direction of gravity toward the bottom of the valve bore 16. This may reduce, at least momentarily, the fuel flowing to the engine and thus a leaner fuel mixture may be provided to the engine than was intended. Further, the fuel may accumulate on the outer surface 85 and/or within the valve bore 16 and an accumulated volume of fuel may be delivered at once to the engine resulting in a temporarily richer than desired or intended fuel mixture being delivered to the engine. The inconsistent fuel mixture may cause variations in engine speed and power, and may increase instability of engine operation.

In at least some implementations, the majority of the outer surface 85 of the nozzle 80 may be generally cylindrical or frustoconical, and oriented generally perpendicular to the centerline 120 of the main bore 13 (where generally perpendicular may mean without 15 degrees of perpendicular). The nozzle 80 may include a discontinuous portion 130 that provides at least one radial deviation or projection 132 that extends outwardly from an adjacent portion of the outer surface 85 (or the majority of the outer surface), and at least a portion of a projection or of the discontinuous portion is arranged at an angle to the centerline 120 that is less than the adjacent portion of the outer surface 85 (or majority of the outer surface). The discontinuous portion 130 may have at least a portion that is oriented at an angle of less than 60 degrees relative to the centerline 120, and/or at least 150 degrees (or 30 degrees if the supplementary angle is used as the reference) relative to the axis 58 of the throttle valve 24, as denoted in FIG. 2 by angles $\alpha$ and $\beta$, respectively. In at least some implementations, at least a portion of the discontinuous portion 130 is located below the fuel outlet 84 relative to the direction of the force of gravity, that is, axially between the fuel outlet 84 and the bottom of the valve bore 16 (relative to throttle valve axis 58), and the discontinuous portion 130 may be within 45 degrees circumferentially of the fuel outlet 84 (relative to the throttle valve axis 58). At least a portion of the discontinuous portion 130 may also be located between the fuel outlet 84 and the outlet of the main bore 13 relative to the direction of the flow of fluid through the main bore 13.

Figure 3:
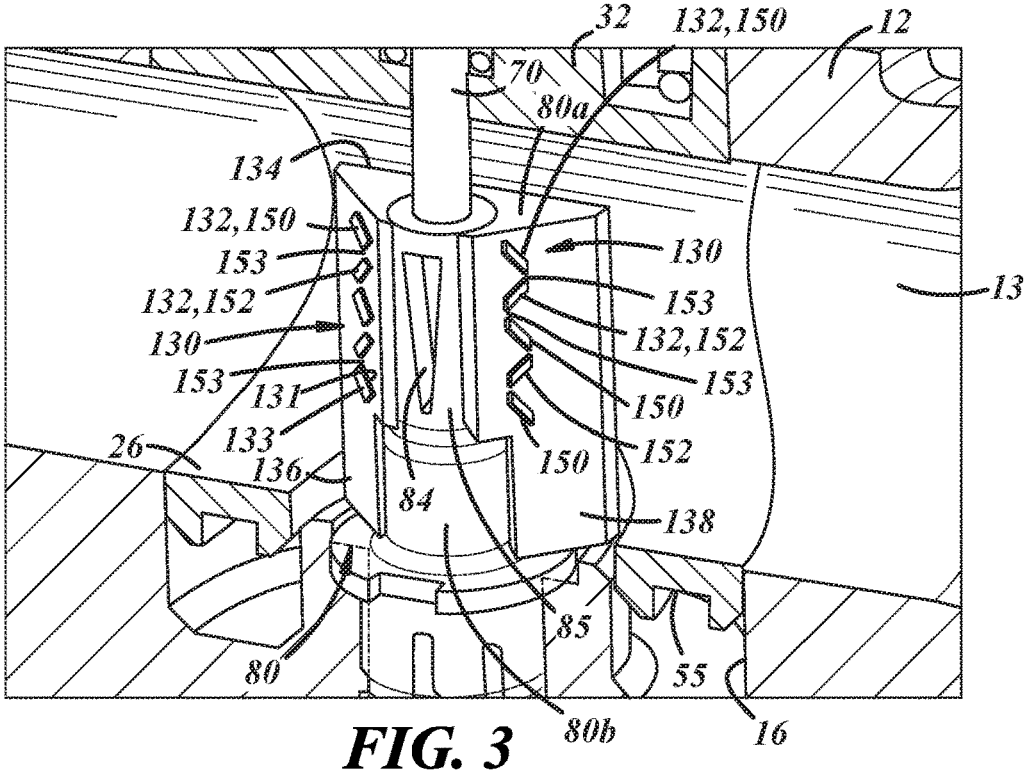
FIG. 3 is a fragmentary sectional view showing a main bore, throttle valve and fuel nozzle of the carburetor.

In at least some implementations, the discontinuous portion 130 (e.g. one or more projections thereof) includes side surfaces 131 (FIG. 3) that extend radially outwardly from the outer surface 85 of the fuel nozzle 80, and a radial outermost surface 133 (FIG. 3) that defines the radially outermost portion of the discontinuous portion and which may be perpendicular, or within fifteen degrees of perpendicular to the side surfaces 131. The projections have an axial extent (relative to axis 58) of any desired length, and the combined or total axial length of a discontinuous portion 130 (which may include one or more than one projection, and a space may be provided between adjacent projections in a discontinuous portion) may be greater than the axial length of the fuel outlet 84. The sides 131 of the projection(s) may be at non-parallel angles to the centerline or axis 58 of the fuel nozzle 80 such that the sides and outer surfaces are canted or inclined in the circumferential direction (e.g. a portion is circumferentially closer to the fuel outlet than another portion). As shown in FIGS. 2 and 3, different portions of the discontinuous portion 130 may be at different angles to the axis 58, and the portions may, if desired, alternate in a zig-zag or sawtooth arrangement. The discontinuous portion 130 may be formed by more than one projection with an axially extending space between axially adjacent projections.

To direct air flow from the main bore 13 inlet toward the fuel outlet 84, or for other reasons, in at least some implementations, the nozzle 80 as shown in FIGS. 3 and 4 may include a rear surface 134 facing in the opposite direction or within 20 degrees of the opposite direction as the fuel outlet 84, where the rear surface 134 is parallel or within 20 degrees of parallel to the centerline 120 (i.e. the direction of air flow through the main bore 13). The rear surface 134 may be generally planar, or it may be contoured or otherwise shaped as desired. Extending from the rear surface 134, the nozzle 80 may include at least one inclined side surface. The side surface(s) may extend from a first side nearer the fuel outlet 84 to a second side joined to the rear surface 134 and spaced farther from the fuel outlet 84. The side surface may be inclined at an angle of between 20 and 50 degrees relative to the centerline 120 of the main bore 13. In the example shown in FIGS. 3 and 4, the nozzle 80 includes two side surfaces 136, 138 with a first side surface 136 arranged with its first side 140 downstream of its second side 142, and the second side surface 138 arranged with its first side 144 upstream of its second side 146, relative to the direction of air flow through the main bore 13, with the inlet 14 being upstream of the outlet 15. The nozzle 80 may include the rear surface 134 and side surface(s) 136, 138 as part of an integral, single piece body formed of metal, plastic, composite or other material(s), or the rear and side surface(s) may be formed in a piece of material **80*a* formed separately from a main body 80*b* of the nozzle 80, as is shown in FIGS. 3 and 4, with the two components coupled or fixed together as desired. The rear and side surfaces may define part of the outer surface 85 of the nozzle 80**.

The discontinuous portion 130 may be formed at least in part on a side surface 136 and/or 138 and may be provided on both of the side surfaces 136, 138. The discontinuous portion 130 may move liquid fuel away from the majority of the outer surface 85 of the nozzle 80 and may also disrupt airflow in that area to increase the likelihood that the liquid fuel will be removed from the nozzle 80 and join the fluid flow toward the main bore outlet 15. In at least some implementations, the discontinuous portion extends over less than ¼ of the circumferential extent of the outer surface 85 of the fuel nozzle 80. The orientation of the sections 150, 152 creates an undercut, overhang or drip edge at the edge of the first section 150 farthest from the outlet 84, where the second section 152 is angled back toward the fuel outlet 84. Liquid that flows along the first section 150 is less likely to flow back in toward the fuel outlet 84 as the force of gravity tends to pull the liquid away from the projection 132 and thus, the liquid is more likely to be swept away by flowing air at the drip edge, overhang or gap created at the junction or between the two portions 150, 152. In this way, the overhang or drip edge forms an undercut relative to the direction of the force of gravity wherein the second section 152 is beneath and overlapped or covered by the first section 150 relative to the direction of the force of gravity. The nozzle 80 may include more than one undercut or overhang with multiple first sections 150 that overlap respective/adjacent second sections 152 located below, relative to the direction of the force of gravity. While the first and second projection sections 150, 152 are shown as being linear and arranged in an alternating outward/inward zig-zag pattern, they need not be and can be of any desired shape and orientation.

Further, in at least some implementations, an angle between a side of a projection 132 and the outer surface 85 may be at least 60 degrees, and is preferably 90 degrees (i.e. perpendicular) to provide a sharp transition from the outer surface 85 to the projection 132 to better disrupt liquid fuel flow along the outer surface 85 of the nozzle 80. In the embodiment shown in FIGS. 1 and 2, separate discontinuous portions are shown both upstream and downstream of the fuel outlet 84, that is, on both circumferential sides of the fuel outlet 84. These are arranged as zigzagged or in a saw tooth configuration extending from a first or upper end that is farther from the bottom of the valve bore 16 than a second or lower end. Likewise, separate discontinuous portions including separate projections may be provided with one projection on each of the side surfaces 136, 138 in the embodiment shown in FIGS. 3 and 4. These projections are also shown as zigzagged or in a saw tooth configuration extending from a first or upper end that is farther from the bottom of the valve bore 16 than a second or lower end. Further, as shown in FIG. 2, a projection 132*a* that defines a discontinuous portion may have a surface closest to the fuel outlet 84 that is perpendicular to the throttle valve axis 85 and extends radially outwardly from the outer surface 85. This projection 132*a* may be located below the fuel outlet 84 and circumferentially aligned with the fuel outlet 84 rather than circumferentially offset from the fuel outlet as with the projections 132 described above.

The discontinuous portion 130, in at least some implementations, does not provide a smooth, linear path for liquid to flow under the force of gravity, and instead creates a circuitous path and/or one or more overhangs/undercuts and a radially outwardly extending surface that tends to move liquid away from the outer surface 85 of the nozzle 80 to cause more liquid to flow off of the nozzle 80 and into the main bore 13 downstream of the nozzle. With less liquid on the nozzle 80, the flow of liquid from the main bore 13 is steadier (not lean as may occur when more liquid is on the nozzle). And with less liquid pooling or collecting, for example in the bottom of the valve bore 16, after flowing along the nozzle 80, the flow of liquid from the main bore 13 also is steadier with less intermittent periods of a rich mixture due to collected liquid being delivered to the engine periodically. In turn, the engine operation may be more consistent, with less variation in speed and power for a given throttle position.

Figure 5:
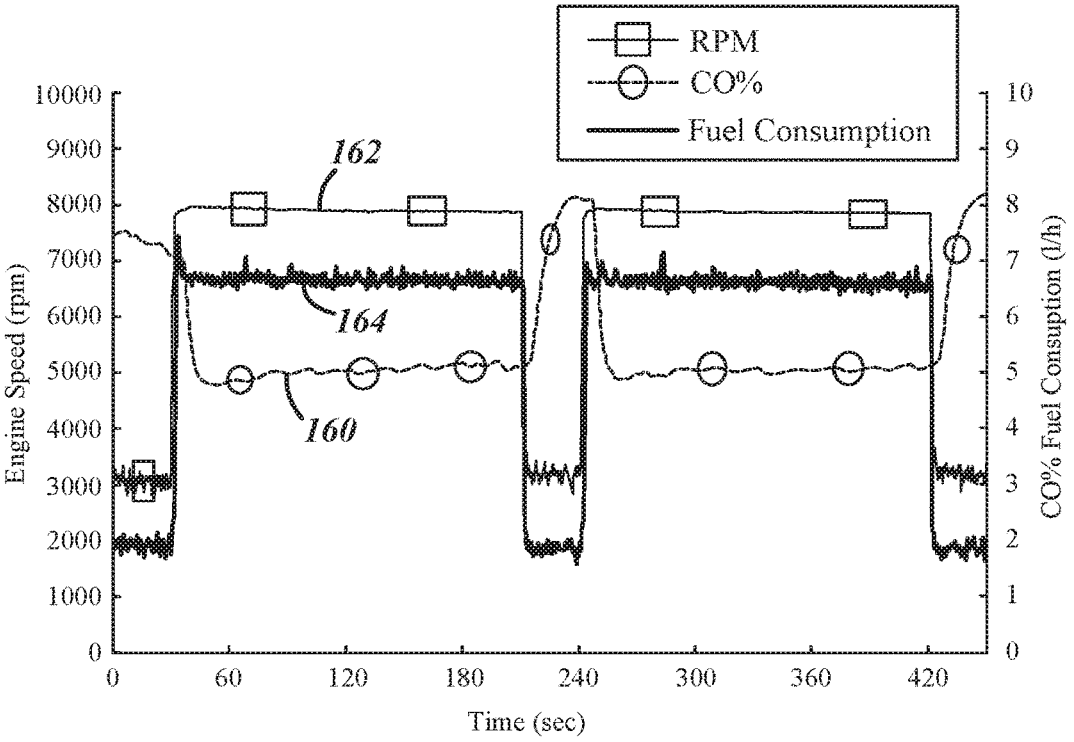
FIG. 5 is a graph showing engine characteristics with the fuel nozzle of FIGS. 1-4.
Figure 6:
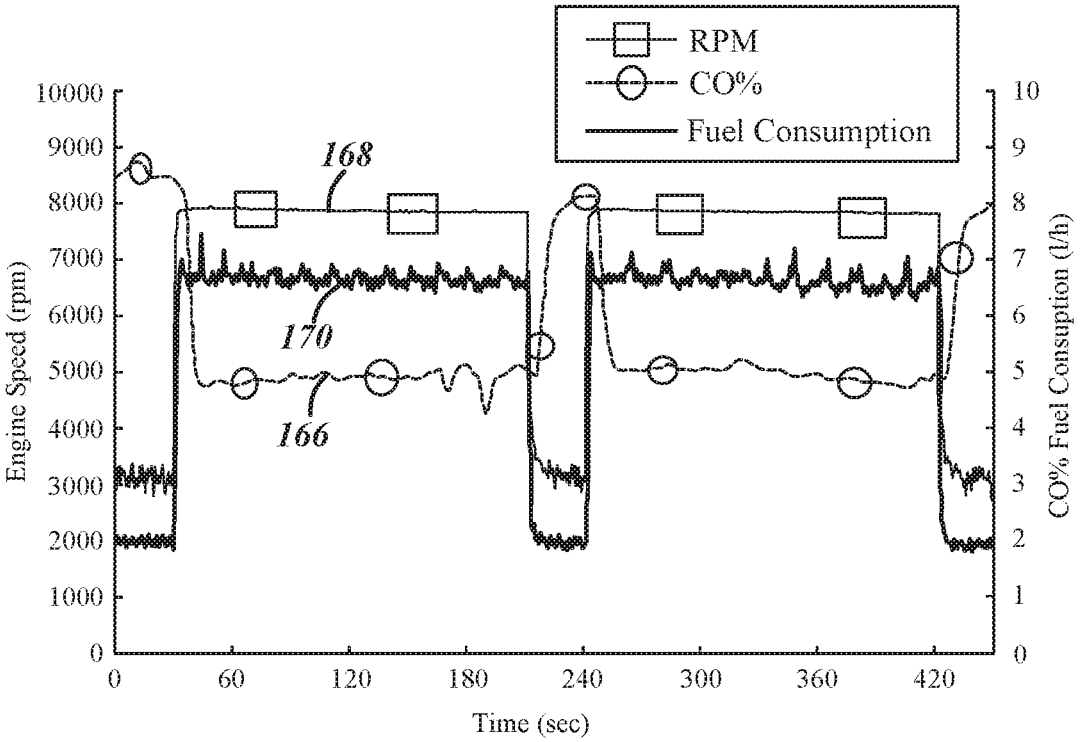
FIG. 6 is a graph showing engine characteristics with a conventional fuel nozzle.

FIG. 5 is a graph showing certain engine performance characteristics with use of the nozzle including the discontinuous portion(s) 130. Carbon monoxide percentage, engine speed in revolutions per minute and fuel consumption are shown by the three lines 160, 162, 164, respectively. FIG. 6 is a graph of carbon monoxide percentage, engine speed in revolutions per minute and fuel consumption for an engine fed by a carburetor with a conventional nozzle, not including a discontinuous portion, and these characteristics are shown by lines 166, 168, 170, respectively. With the innovative nozzle including one or more discontinuous portions, the carbon monoxide percentage and fuel consumption are significantly and surprisingly steadier, with less deviation, indicating steadier fuel supply to the engine and steadier engine operation, as noted above. Thus, the relatively simple addition of projections to disrupt fuel flowing along the outer surface 85 of the nozzle measurably improved engine performance. The graphed engine operation characteristics are representative of the type of improvement experienced with the innovative nozzle and are not intended to show all benefits, or to limit the innovation to such improvements.

The forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A rotary throttle valve carburetor, comprising:

a main body having a main bore with an inlet into which air enters the main bore and an outlet from which air and fuel exit the main bore, the main body also has a valve bore that intersects the main bore and a nozzle opening that communicates with the main bore;

a throttle valve having a valve body received at least partially within the valve bore so that the valve body rotates about an axis and moves axially relative to the main body, the throttle valve having a valve passage therethrough which is more aligned with the main bore in one position of the throttle valve than in another position of the throttle valve; and a fuel nozzle extending through the nozzle opening and into the valve passage, the fuel nozzle having a fuel outlet received within the valve passage, an inner surface that defines part of a fuel passage through which fuel flows in the nozzle and to the fuel outlet, and the fuel nozzle has an outer surface that includes a discontinuous portion having a varying radial dimension within the portion of the fuel nozzle that is within the valve passage; and wherein the nozzle has a rear surface facing in the opposite direction or within 20 degrees of the opposite direction as the fuel outlet, where the rear surface is parallel or within 20 degrees of parallel to the direction of air flow through the main bore.

2. The carburetor of claim 1 wherein the discontinuous portion is located below the fuel outlet relative to the direction of the force of gravity.

3. The carburetor of claim 1 wherein at least a portion of the discontinuous portion is located between the fuel outlet and the outlet of the main bore relative to the direction of the flow of fluid through the main bore.

4. The carburetor of claim 1 wherein the nozzle includes at least one inclined side surface that extends from a first side near the fuel outlet to a second side joined to the rear surface, and wherein the at least one side surface is inclined at an angle of between 20 and 60 degrees relative to the direction of the flow of fluid through the main bore.

5. The carburetor of claim 4 wherein the discontinuous portion is formed on the at least one side surface.

6. The carburetor of claim 4 wherein the nozzle includes two side surfaces with a first side surface arranged with the second side upstream of the first side relative to the direction of air flow through the main bore, and a second side surface arranged with the first side upstream of the second side relative to the direction of air flow through the main bore.

7. The carburetor of claim 1 wherein the fuel outlet is oriented perpendicular to or within 30 degrees of perpendicular to a centerline of the main bore.

8. The carburetor of claim 1 wherein the discontinuous portion has at least a portion that is oriented at an angle of less than 60 degrees relative to a centerline of the main bore.

9. The carburetor of claim 1 wherein the discontinuous portion is within 45 degrees circumferentially of the fuel outlet.

10. The carburetor of claim 1 wherein a portion of the outer surface of the fuel nozzle is located within the valve passage and is cylindrical or frustoconical, and oriented perpendicular to or within fifteen degrees of perpendicular to the centerline of the main bore, and the discontinuous portion extends radially outwardly from the outer surface and covers less than ¼ of the circumference of the outer surface.

11. The carburetor of claim 1 wherein the discontinuous portion is formed in a piece of material that is formed separately from a main body of the nozzle, wherein the main body of the nozzle defines the fuel passage.

12. The carburetor of claim 5 wherein the at least one side surface is formed in a piece of material that is formed separately from a main body of the nozzle, wherein the main body of the nozzle defines the fuel passage.

13. A rotary throttle valve carburetor, comprising:

a main body having a main bore with an inlet into which air enters the main bore and an outlet from which air and fuel exit the main bore, the main body also has a valve bore that intersects the main bore and a nozzle opening that communicates with the main bore;

a throttle valve having a valve body received at least partially within the valve bore so that the valve body rotates about an axis and moves axially relative to the main body, the throttle valve having a valve passage therethrough which is more aligned with the main bore in one position of the throttle valve than in another position of the throttle valve; and a fuel nozzle extending through the nozzle opening and into the valve passage, the fuel nozzle having a fuel outlet received within the valve passage, an inner surface that defines part of a fuel passage through which fuel flows in the nozzle and to the fuel outlet, and the fuel nozzle has an outer surface that includes a discontinuous portion having a varying radial dimension within the portion of the fuel nozzle that is within the valve passage, and wherein the discontinuous portion is defined at least in part by a projection that extends outwardly from an adjacent portion of the outer surface of the nozzle wherein the projection has a side that extends radially from the fuel nozzle, relative to an axis of the fuel nozzle, and an angle between the side of the projection and the outer surface of the fuel nozzle is at least 60 degrees.

14. The carburetor of claim 13 wherein the angle between the side of the projection and the outer surface of the fuel nozzle is 90 degrees.

15. The carburetor of claim 13 wherein the discontinuous portion includes at least one projection that is angled circumferentially with a first portion of the projection located closer to the fuel outlet than a second portion of the projection spaced axially from the first portion.

* * * * *